United States Patent [19]

Schueler

[11] 4,094,498

[45] June 13, 1978

[54] SEPARATOR

[75] Inventor: Marlin A. Schueler, San Leandro, Calif.

[73] Assignee: Tion Equipment Company, Oakland, Calif.

[21] Appl. No.: 818,074

[22] Filed: Jul. 22, 1977

[51] Int. Cl.[2] ..... B65H 41/00

[52] U.S. Cl. ..... 270/52.5

[58] Field of Search ..... 270/52.5, 61 F, 79; 197/133 F

[56] References Cited

U.S. PATENT DOCUMENTS

| | | | |
|---|---|---|---|
| 3,079,142 | 2/1963 | Pine | 270/52.5 |
| 3,255,662 | 6/1966 | Call | 270/52.5 |
| 3,857,557 | 12/1974 | Gill | 270/52.5 |
| 3,944,206 | 3/1976 | Bower | 270/52.5 |

*Primary Examiner*—Edgar S. Burr
*Assistant Examiner*—A. Heinz
*Attorney, Agent, or Firm*—Alvin E. Hendricson

[57] ABSTRACT

A device for separating a sheet of computer or printout paper from other such papers and carbon papers in a sheet of multiple levels as are commonly employed in computer printouts is designed for table top use with only a short "fall" of discharged paper sheets and a particularly designed folder for insuring proper folding of discharged sheets to thus provide a tabletop separator.

8 Claims, 8 Drawing Figures

SEPARATOR

BACKGROUND

The handling of computer printout sheets has led to the development of many pieces of relatively sophisticated equipment including separators, collators, bursters, trimmers and the like. Normally, printers associated with computers employ very long ribbons of paper perforated or otherwise laterally marked to denominate successive connected sheets in multiple layers with carbon paper between the layers. The foregoing paper has uniformly spaced perforations along one or both edges for indexing the paper as it is moved through a printer. In addition, various means are employed to join the multiple layers of the elongated ribbon of sheets together. Such means include what are commonly termed "disappearing glue" or "finger locks". Attachment means, such as the foreoging, are required to hold the layers together during printing and processing; however, the separation of one layer from the others requires means for "breaking" this connection of layers.

After printing of data upon the multiple layers of "computer paper" or "printout paper" it is normally required that successive layers be individually separated and intervening carbon paper be discarded in order that successive sheets of each layer may be variously employed as, for example, as billing sheets, inventory records or the like, and other layers may, for example, be folded and bound as permanent records of computed and printed information.

Breaking of adhesive connections between layers of computer printouts is not difficult. Refolding of separated layers has, however, proven more difficult, and normally it is necessary for separator devices to provide a long "fall" or vertical passage of separated layers in order to insure refolding and orderly return of unseparated and separated sheets into folded condition for future handling. This refolding of successive sheets of a ribbon of sheets wherein one ribbon, for example, is separated from the remainder of connected ribbons, poses particular problems that have only been solved in the prior art by the provision of a long "fall" or vertical traverse of sheets down to a refolding platform whereat a transverse or lateral bar is provided for the purpose of "breaking" each sheet to fold or bend same laterally across the center thereof.

The foregoing refolding operation may seem to be very simple to those that are uninitiated in the problems of rapidly moving sheets of paper; however, serious studies of the movement of a ribbon of paper in the air has established at least the unpredictability of the ultimate disposition thereof. It has been determined that the weight of falling paper onto a refolding platform is normally of major importance in forcing or producing refolding of the successive sheets of a ribbon of computer paper. Consequently, prior art separators of one layer of conventional computer paper from a plurality of layers thereof require a vertical distance of the order of three feet or more for the separated layers to be refolded as required for subsequent handling of such sheets. Because of this limitation, separators of this type must be quite large.

The present invention provides a simple, but very advantageous solution to the problems encountered by the prior art as set forth in part above.

SUMMARY OF INVENTION

The present invention provides a system or device for separating one sheet of printed material from a plurality of printed sheets and interleaved carbon paper as is normally ejected from a printer associated with a computer. The present invention comprises a table top device for accomplishing the foregoing functions wherein the successively connected sheets are folded after a vertical fall or travel of only about 1½ feet at the most and about 1 foot at the least.

The device of this invention includes a first driven roller with a freely rotatable breaker roller above same and pressure wheels engaging paper extending over the driven roller. Multiple layers of computer printout paper are threaded in the device with the top layer to be removed from the remainder extending over the breaker roller and the remaining layers extending about the first drive roller beneath the pressure wheels. A carbon take-up member is rotated with the top layer carbon paper wrapped thereabove, and the top layer is passed over a second driver roller with pressure wheels bearing thereon.

Two folding stations are provided, with the first station being disposed between and below the two drive rollers, and the second station being disposed immediately beyond and below the second drive roller. The separated top layer of paper moves downwardly from the second drive roller a short distance, such as 18 inches to engage a folding wedge having the shape of an offset pyramid for insuring the folding of successive sheets of the layer along perforations therebetween. The remaining layers of paper and interleaved carbon paper are refolded at the first folding station whereat a like folding wedge is located.

In the refolding of a sheet of printout paper, the folding commences as the paper falls or advances downwardly from a feed roller because of the previously existing fold lines along perforations or the like across the sheet. As a corner of a fold settles downward upon a stack of folded portions of the sheet, it is quite possible for this corner to engage a perforation along the edge of the sheet at the top of the stack or to engage a finger hold thereat. Any such engagement may cause the sheet to buckle under and fold in some other way than along the fold line, so that the stack is disarranged and proper folding of the stack is not possible. So called slow-speed devices for separating one layer of printout paper from multiple layers thereof may operate at 125 feet per minute, for example, and thus any disruption in folding and stacking produces great disarray before even an observant operation can stop the machine and correct the difficulty.

It is conventional in refolding operations to provide a bar or upright plate extending laterally across the stacking or refolding area so that each sheet is bent downwardly ahead and behind the center thereof. The foregoing has been found to be advantageous, if not necessary, in order to obtain proper refolding. However, this structure is not adequate for relatively slow-speed operations nor for table top machines wherein the sheet or sheets to be refolded, move only a short distance downwardly from a drive roller to a stacking or folding surface.

The present invention provides an improved and highly advantageous folding action by the provision of the folding wedge hereof. As a layer of printout paper or the like moves downwardly it approaches and engages a triangular surface inclined upwardly to the point thereof away from the drive roller. Thus as each sheet of the layer comes to rest on the wedge, the sheet is bent over the wedge with the forward center portion of the sheet raised and the outer or front corners extending substantially downward therefrom. It will thus be seen that each sheet of the layer of paper falls upon the wedge with the forward corners raised from the previous sheet of the stack and these corners then lower themselves generally vertically onto the stack rather than possibly moving longitudinally thereof. This motion of the successive sheets is highly advantageous in precluding misfolding or jams in folding that otherwise disrupt the stack of folded sheets.

DESCRIPTION OF FIGURES

The present invention is illustrated as to a preferred embodiment thereof in the accompanying drawings, wherein.

DESCRIPTION OF PREFERRED EMBODIMENT

Figure 2:
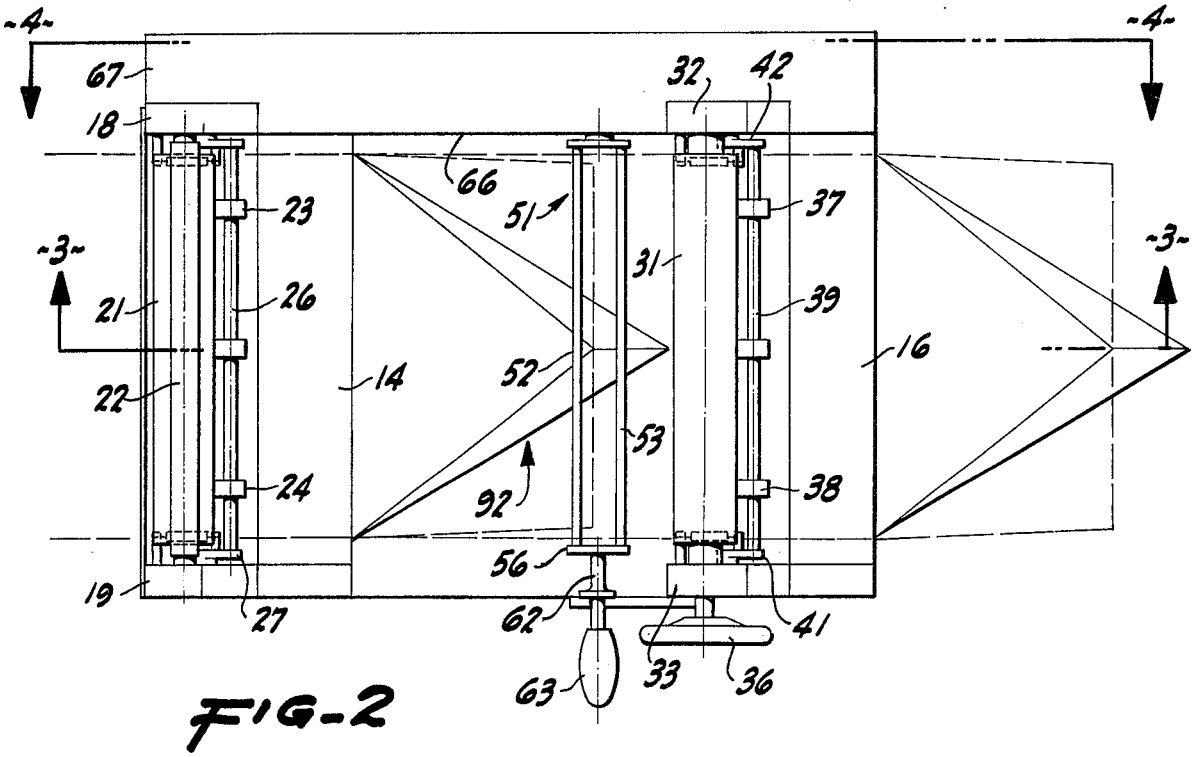
FIG. 2 is a top plan view of the separator of FIG. 1.
Figure 1:
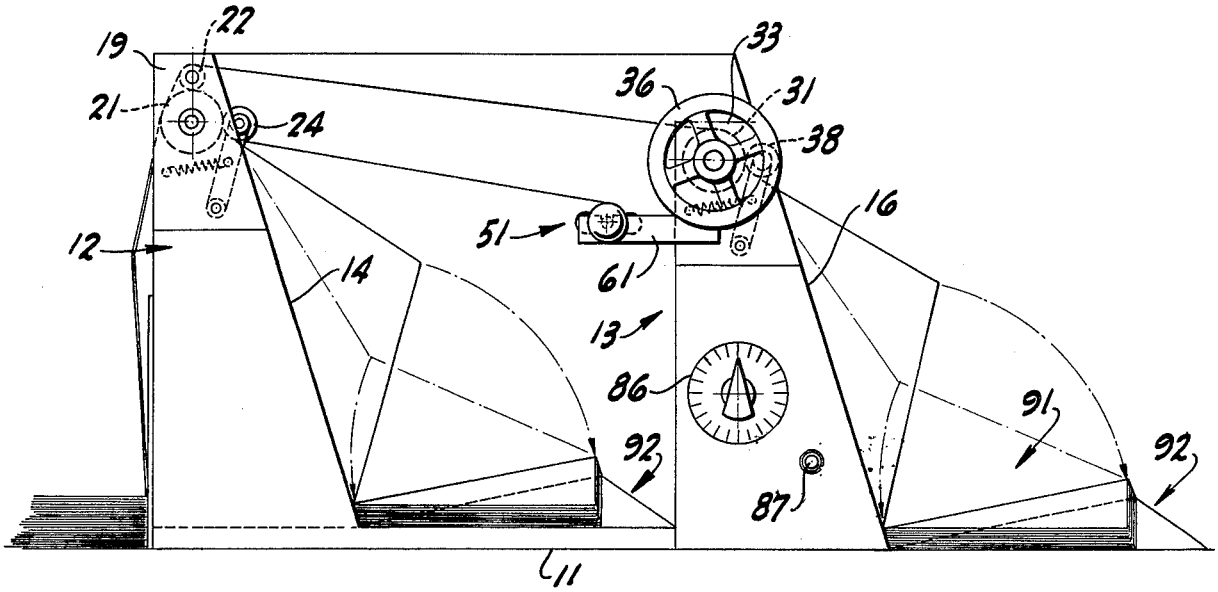
FIG. 1 is a side elevational view of a separator in accordance with the present invention.

The device or machine of the present invention, as illustrated in FIGS. 1-4 of the drawings includes a base plate 11 having a first or front transverse wall 12 extending upwardly across the leading edge thereof, and a second or rear transverse wall 13 extending laterally across the rear of the base. Each of these walls 12 and 13 has the rear surfaces 14 and 16, respectively thereof inclined downwardly and outwardly, as indicated in FIG. 1, and between the walls upon the base 11 there is provided a first folding station 17. A pair of upright bearing mounts 18 and 19 are mounted atop the wall 12 with one disposed at each end thereof, and between these bearing mounts there is rotatably mounted a first drive roller 21. Immediately above the first drive roller 21, there is rotatably mounted what may be termed a breaker roller 22 which is mounted to freely rotate in the bearing mounts 18 and 19. A pair of pressure wheels 23 and 24 are mounted for rotation in spaced relation upon a shaft 26 carried at the ends thereof by spring-loaded levers 27 for urging the pressure wheels 23 and 24 against the surface of the first driven roller 21 above the back side 14 of the first wall 12. The mounting levers 27 may be pivotally mounted in the bearing mounts 18 and 19 at an angle thereto, as indicated in FIG. 1, with small tension springs 28 urging the pressure wheel shaft 26 toward the first driven roller 21.

A second driven roller 31 is mounted for rotation atop the second wall 13 between a pair of upright bearing mounts 32 and 33 secured to the top of the back wall at the opposite ends thereof in extension upwardly therefrom. This second driven roller 31 is mounted upon a shaft 34 which extends through the outer or front bearing mount 33 and carries a hand wheel 36 on the outer end thereof for manually rotating the roller 31. A second pair of pressure wheels 37 and 38 are mounted on a shaft 39, that is in turn carried by spring-loaded levers 41 pivotally mounted in the bearing mounts 32 and 33. Small tension springs 42 urge the levers 41 to move the shaft 39 toward the second driven roller 31 so that the pressure wheels 37 and 38 are forcibly pressed against the surface of this roller or materials carried thereover.

In addition to the first and second driven rollers 21 and 31, there is also provided a rotatably driven fork 51 which may, for example, be comprised as a pair of spaced parallel bars or tines 52 and 53 extending between discs 54 and 56. This rotatably driven rollers adjacent the second roller and slightly below the level thereof. This mounting may be accomplisyed by the provision of a bracket 61 secured to the bearing mount 33 with a notched shaft 62 extending from the disc 56 and having the notch thereof fitting into a rounded depression in the upper surface of the bracket 61 with a handle 63 extending from the shaft 62. The other end of the fork structure 51 has a short shaft 64 extending axially from the disc 54 through a side wall 66 of a side housing 67. This housing 67 is attached to one end of each of the walls 12 and 13 and houses a portion of the drive means as described below.

The tines or rods 52 and 53 of the fork structure or element 51 fit into apertures in the back disc 54 and are thus rotated thereby but are removable therefrom. Removal of the fork structure may be readily accomplished by gripping the handle 63 and lifting the shaft 62 from the depression in the bracket 61, and then withdrawing the bars 52 and 53 from the disc 54. The rotatably mounted fork structure 51 is provided for the purpose of wrapping carbon paper thereabout, as further discussed below, and it is necessary that this fork structure be readily removed so that carbon paper wrapped thereabout may be readily discarded therefrom. By slipping the rods 52 and 53 out of the disc 54 secured in the end of shaft 64, it is only necessary to hold the fork structure over a waste basket or the like by the handle 63 with the structure depending therefrom and to shake or push the carbon paper off of the bars of the structure into the waste basket.

Figure 4:
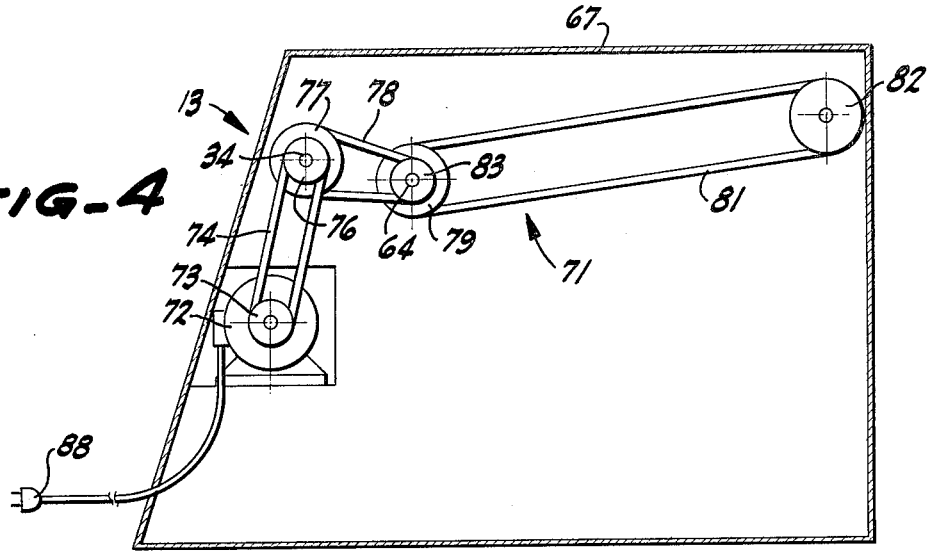
FIG. 4 is a vertical elevational view of the back side of the separator taken in the plane 4—4 of FIG. 2.

The rollers 21 and 31, as well as the fork structure 51, of the present invention are rotatably driven by drive means, such as illustrated in FIG. 4 of the drawings. The drive and coupling means 71 is shown in FIG. 4 to include an electric motor 72, mounted, for example, on a crosspiece in the vertical wall 13, and having a pulley 73 on the shaft thereof with a drive belt 74 thereabout extending over a pulley 76 on the shaft 34 of the second roller 31. A second pulley 76 on the shaft 34 engages a drive belt 78 extending about a pulley 79 on the shaft 64 of the fork means 51. The first roller 21 is, in turn, driven by a belt 81 extending about a pulley 82 on the shaft thereof and also about a second pulley 83 on the shaft 64. It will be appreciated that various drive and coupling means may be employed and the one described above is only exemplary. Preferably, provision is made for adjusting the speed of the rotation of the rollers of the present invention, and this may be readily accomplished by providing a variable speed motor 72 with control means 86 mounted, for example, on the outer side surface of the wall 13 and, as shown in FIG. 1 in conformity with general practice, a fuse 87 is provided in the motor circuit. It will be appreciated that the motor is adapted to be electrically plugged into a conventional convenience outlet, as by means of an electrical conductor plug 88.

The present invention provides for rotating the first drive roller 21 at a controllably adjustable speed, and rotating the second drive roller 31 at a slightly greater speed with the fork means 51 being rotated at an intermediate speed. The foregoing is accomplished by the choice of appropriate pulley diameters in the drive and coupling means 71, somewhat in the manner illustrated. It is noted that the relative rates of rotation of the rollers 21 and 31, and particularly of the fork 51, must be fairly similar and the slightly increased rate of rotation of the second roller with respect to the first roller is provided to tension the layer of printout or computer paper drawn through the device. Care must be taken, however, not to rotate the fork element 51 so rapidly as to tear carbon paper adapted to be wrapped thereabout, as further discussed below.

Figure 5:
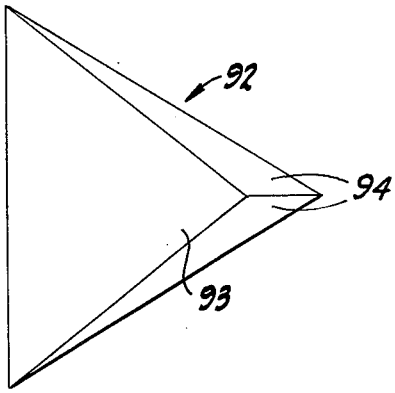
FIG. 5 is a top plan view of the folding wedge of the present invention.
Figure 6:
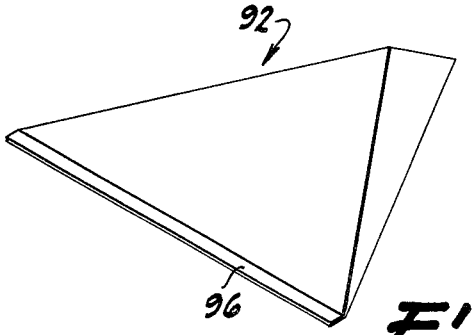
FIG. 6 is a perspective view of the folding wedge of FIG. 5.

In addition to the foregoing elements of the present invention, there are provided a first folding station 17 between the upright walls 12 and 13, as previously noted, and a second folding station 91 immediately beyond the second upright wall 13. Each of the folding stations 17 and 91 is provided with a folding wedge 92, as separately illustrated in FIGS. 5 and 6. The wedge 92 has a triangular top surface 93 and inclined side walls 94 so that the apex of the triangular top is raised above the base thereof and the wedge thus has the exterior configuration of a tetrahedron. Preferably, the folding wedge 92 is dimensioned to at least approximately fit the spacing on the base 11 between the upright walls 12 and 13 and if desired, the folding wedge employed at the second folding statin 91 may have a lip 96 (shown only in FIG. 6) extending across the base of the triangular upper surface 93 to fit beneath the edge of the base 11 of the device for anchoring the wedge in this position. The wedge 92 is adapted to be disposed at each of the folding stations with the base of the triangular upper surface 93 disposed continuously with the inclined surface of the adjacent vertical wall of the device. Additionally, the width of the base of the triangular upper surface 93 of the wedge is made substantially equal to the length of the rollers 21 and 31, although this base width may be somewhat smaller.

Figure 7:
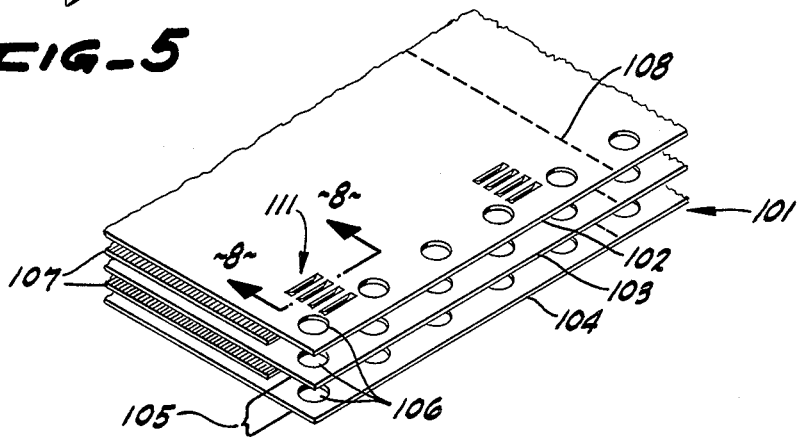
FIG. 7 is a partial expanded perspective view of a plurality of layers of conventional computer printout paper with interleaved carbon paper and having the layers held together by "finger locks"
Figure 8:
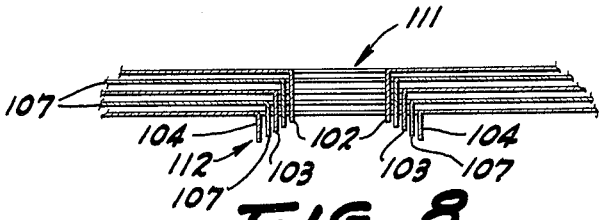
FIG. 8 is an expanded partial sectional view of the layers of paper of FIG. 7 taken through a finger lock in the plane 8—8 of FIG. 7.

Before describing the operation of the present invention, reference is first made to FIGS. 7 and 8, illustrating in part, a conventional multilayer printout paper 101. A plurality of layers of paper 102, 103 and 104, for example, are provided one atop the other with aligned holes 106 along one or both edges of the layers, and the layers are interleaved with carbon paper 107. Each of the layers 102, 103 and 104 is provided as elongated strips or ribbons of successive sheets of paper with perforations 108 between successive sheets of each layer. The combination of layers of printout paper with interleaved carbon paper are removably held together by any one of a variety of means, such as finger locks 111 or possibly, a thin coating of an adhesive along the edges of the layers between the aligned holes 106 thereat. Finger locks 111 may be formed in a variety of ways, but in general, they are formed by cutting and forcing small fingers 112 of paper downwardly from the upper layer 102 through the central layer 103 and the bottom layer 104 somewhat as indicated in FIG. 8, to thus temporarily lock the layers and interleaved carbon paper together. It will be seen that removal of the upper layer 102 from the remainder of the layers will cause these fingers 112 of layer 102 to become disengaged from the lower layers and to depend from the underside of the upper layer 102. It is also noted that fingers of layers 103 and 104 also extend from the undersurface of the remainder of the multilayer printout paper and thus the following description of the top layer also applies to the remainder or connected layers 103 and 104. These fingers form somewhat of a rough undersurface for the upper layer 102 and also for the remainder and thus it is quite possible for these fingers to engage any irregularity or opening in a sheet or layer upon which they may be placed, and thus to buckle the layer being placed thereon. In particular, the composite printout paper 101 is normally folded along the fold lines 108, and after separation of a top layer 102 therefrom, is refolded along these fold lines. This refolding operation provides for successive sheets of the layer 102 to be folded one atop the other, and in this operation, the depending fingers 112 tend to engage the openings 106 along the edge of this layer so as to prevent a smooth folding operation. The present invention is particularly directed to the separation of the top layer 102 from a multilayer computer or printout paper 101, and the smooth refolding of the separated layer and the remainder of the printout paper, in separate piles. The foregoing is accomplished in the manner set forth below in the description of operation of the present invention.

Figure 3:
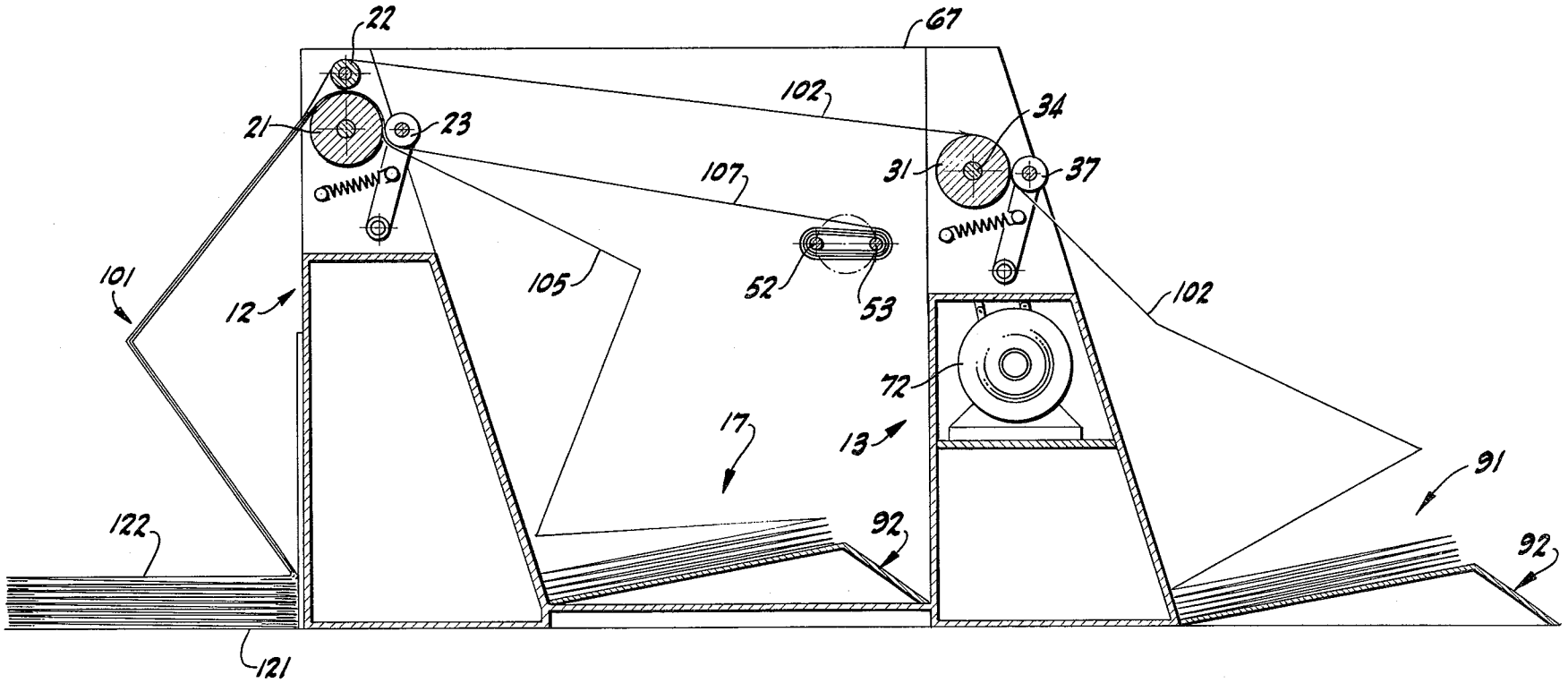
FIG. 3 is an enlarged central vertical sectional view of the separator taken in the plane 3—3 of FIG. 2.

Considering now the threading of computer or printout paper 101 through the present invention, and referring particularly to FIG. 3 of the drawings, it will be seen that the separator of the present invention is adapted to be disposed upon a desk top or the like 121, with a stack 122 of multilayered paper 101 placed immediately in front of the front vertical wall 12 of the present invention. The paper is initially separated at the leading edge thereof, as by hand, to displace the upper layer 102 from the remainder of the layers of paper and carbon paper. The remaining layers and upper carbon paper is placed about the first roller 21 beneath the pressure wheels 23 and 24, and the upper layer of carbon paper 107 is there separated from the remainder, herein denominated by the numeral 105. The upper carbon paper 107 is led to the fork structure 51 and wound thereabout. The remainder 105 falls downwardly from the first drive roller to the first folding station 107. The upper layer 102 is placed over the breaker roller 22 and the layer 102 is thereby separated from the multilayer paper 101. The upper layer 102 is extended over the second drive roller 31 beneath the pressure wheels 37 and 38 thereon and downwardly therefrom into the second folding station 91. The rollers 21 and 31, as well as the fork 51, may be rotated during this operation by the hand wheel 36.

It will be appreciated that threading of the separator of the present invention requires the separation of a plurality of successive sheets of the layer 102 from the remainder of the layers 105. Preferably, sufficient length is separated and extended through the separator hereof to form at least a few folds of sheets of layer 102 at the second folding station 91. Following the foregoing threading of the machine, the electric motor 71 is energized and adjusted to the desired speed of operation of the machine for drawing paper therethrough and separating the paper. As the first drive roller 21 is rotated, the paper 101 will be drawn upwardly with the upper layer 102 passing over the breaker roller 22 so that the upper layer is separated from the remainder of layers at this point. The upper layer is drawn over the roller 22 by the second drive roller 31 which is rotated by the motor 71 with the layer 102 being held thereaginst by the pressure wheels 37 and 38. The carbon paper 107 between the upper layer 102 and remainder of layers 105 is wrapped about the fork mechanism 51 as the latter is rotated and is thus also separated from the remainder 105. As noted above, the second roller 31 is rotated at a slightly greater rate than the first roller 21, in order to prevent sagging of the upper layer 102 between these rollers and, similarly, the fork mechanism 51 is rotated at a very slightly greater rate than the first roller 21, in order to apply a small tension to the carbon paper 107.

As the separated upper layer 102 passes over the second drive roller 31, it falls toward the second folding station 91, abd because of the lateral perforations 108 across this upper layer 102, the layer will tend to fold in falling into this folding station with the folds being alternately forward and backward in conventional manner. The present invention operates to prevent edges of the layer 102 entering the folding station from sliding along the edges of the layer already folded thereat. The purpose of this limitation is to prevent a folded corner of the layer 102 from possibly entering one of the edge openings 106 in the already folded portion of the layer, and also from preventing the depending fingers 112 from engaging or entering one of these edge apertures 106 of the already folded layer. Either of the foregoing occurrences could, and quite possibly would, bend a sheet of the descending layer 102 so as to fold the layer between the fold lines, rather than along the fold lines, so as to disrupt orderly refoldings of the layer. The above-noted occurrences are prevented in the present invention by the provision of the folding wedge 92, whereby the center of the descending layer 102 first engages the wedge or folded layers thereon, and any sliding of a descending sheet of the layer 102 of the already folded sheets will occur along the center of the sheets rather than along the edges thereof. As each sheet of the layer 102 comes to rest in the folding station, it will be inclined downwardly from the leading edge thereof toward the lateral edges thereof upon the wedge 92. This disposition of the refolded layer 102 does not provide any difficulty, but instead, provides a material advantage in preventing any possible engagement of the edges of successive sheets of the layer 102 as this layer is refolded at the station 91.

The folding of the remainder 105 of the layers at the first folding station 17 is accomplished in the same manner as described above for folding of the upper layer 102 at the second folding station. The problem of depending fingers is also present at the first folding station, and further, it is possible for a leading corner of a fold along a fold line 108 to engage an opening 106 along an edge of an already folded sheet, so as to buckle the folding portion and disrupt the folding operation. Consequently, it is preferred herein that the first folding station also employ a folding wedge 92. It is noted with regard to refolding of layers of computer or printout paper after separation of one layer therefrom, that the vertical distance traversed by the paper before folding is critical. Conventional prior art devices provide a number of feet of vertical fall before refolding, and also operate at a very substantial rate of traverse of paper through the machine. Reduction in the distance of vertical fall increases the difficulty of refolding, and the likelihood of problems such as those discussed above. One embodiment of the present invention provides a vertical distance between the top of the second drive roller 31, for example, and the bottom of the folding station of the order of 2 feet, so that the machine of the present invention is readily disposed upon a table top or desk top and occupies only a half to a third of the physical space of prior art devices of this general type. The width of the present invention is sufficient to accommodate the passage of various sizes of printout paper, and the drive rollers 21 and 31 may, for example, have a length of the order of 16 inches. With the foregoing dimensions of a preferred embodiment of the present invention, the folding wedge may have the dimensions of the length of the base of a triangle of 16 inches, the height of the triangle of the upper surface 93 of 11 inches, and a vertical distance of 4½inches of the apex of the triangle 93 from a horizontal surface 121.

After a stack 122 of paper has been run through the present invention, it will be seen that the upper layer 102 thereof has been refolded at the second folding station 91 and the remainder of the layers have been refolded at the first refolding station 17. Additionally, the carbon paper 107 between the upper layer and remaining layers have been wrapped about the fork mechanism 51. It is noted in this respect that the drive and coupling system of the present invention for rotating the fork mechanism 51 may incorporate a friction clutch in order to insure that the carbon paper 107 is not unduly tensioned between the fork mechanism and first drive roller. With the carbon paper wrapped about the fork mechanism 51, it is quite easy to dispose of this carbon paper merely by grasping the handle 63 and raising the notched shaft 62 out of the depression in the bracket 61, whereby the prongs 52 and 53 of the fork mechanism may be withdrawn from the disc 54. Still gripping the handle 63, the fork mechanism with the carbon paper wrapped thereabout may be readily removed, and the carbon paper slid off of the open ends of the prongs or tines 52 and 53 into a waste basket or the like. The fork mechanism may then be replaced and the machine hereof is in condition for further use. As noted above, the rate of rotation of the drive cylinders of this invention is adjustable as by the speed control means 86, whereby the present invention may be operated at an appropriate rate to handle compter or printout paper supplied thereto from a printer or the like. Additionally, the present invention is particularly adapted for utilization with a table top burster device which operates to separate successive sheets of the perforated layer 102. Although complex high-speed machines for separating successive sheets of a layer of computer or printout paper are well known in the art, it is also possible to separate successive sheets with less complex equipment operating at slower speeds. The present invention is particularly adapted for this use and may operate at 1 foot per second, for example, so as to be advantageously employed in installations wherein somewhat limited capabilities are required so that costs may be minimized.

The present invention has been described above with respect to a single, preferred embodiment of an advantageous table top separator. It will be appreciated by those skilled in the art that numerous modifications and variations may be made within the spirit of the invention, and thus it is not intended to limit the invention to the precise terms of description or details of illustration.

What is claimed is:

1. A separator for removing the top layer of printout paper from a plurality of layers thereof comprising:

a first rotatable drive roller having pressure wheels resiliently urged against said roller and a rotatably mounted breaker roller disposed adjacent thereto, a second rotatable drive roller spaced from said first roller for defining a first folding station therebetween and having pressure wheels resiliently urged against said second roller, a rotatably driven fork structure including at least two adjacent parallel tines disposed intermediate and parallel to said first and second rollers above said first folding station, and at least one folding wedge disposed at a second folding station adjacent and below said second roller on the opposite side thereof from said first roller, said wedge being in the form of a tetrahedron wherein one of the triangular faces of the tetrahedron forms an inclined upper surface for supporting the successive sheets as they are refolded in a stack, said upper surface having a common edge with the base of the tetrahedron substantially parallel to said second drive roller, whereby successive sheets of a separated layer of printout paper are refolded and deposited on said triangular upper surface with fold lines adjacent said common edge.

2. The separator of claim 1 further defined by a variable speed electric motor coupled to said first and second drive roller and to said fork structure for rotating these elements and adjustable speed control means connected to said motor for setting the rate of rotation of said rollers and fork structure.

3. The separator of claim 2 further defined by a hand wheel connected to a shaft of one of said drive rollers for hand rotation of both of said drive rollers and said fork structure.

4. The separator of claim 2 further defined by means coupling said variable speed motor to said rollers and fork structure for rotating said second drive roller slightly faster than said first drive roller and said fork structure at an intermediate rate of rotation.

5. The separator of claim 1 further defined by said folding wedge having a length across the base of said inclined triangular upper surface substantially equal to the length of said drive rollers.

6. The separator of claim 1 further defined by the upper surface of said wedge having an isosceles triangular configuration.

7. The separator of claim 1 further defined by a second folding wedge like said first folding wedge disposed at said first folding station with the base of a triangular upper surface thereof adjacent and aligned with said first drive roller.

8. The separator of claim 1 further defined by said fork structure including a rotatably driven disc having apertures therein, said tines being connected together at a first end thereof with a notched shaft extending axially of the tines at said first end and removably fitting into a depression in a support bracket with a second free end of said tines removably engaging the apertures in said disc whereby said fork structure is adapted to wind carbon paper thereabout and to be removed from the reaminder of the separator for disposal of such carbon paper.

* * * * *